United States Patent [19]

Rein

[11] Patent Number: 4,926,090

[45] Date of Patent: May 15, 1990

[54] TELEVISION PICTURE TUBE HAVING A COMPOSITE FRONTAL PANE

[75] Inventor: Wilhelm Rein, Fürth, Fed. Rep. of Germany

[73] Assignee: Flabeg GmbH, Fürth, Fed. Rep. of Germany

[21] Appl. No.: 243,098

[22] PCT Filed: Dec. 12, 1987

[86] PCT No.: PCT/DE87/00591

§ 371 Date: Aug. 17, 1988

§ 102(e) Date: Aug. 17, 1988

[87] PCT Pub. No.: WO88/04828

PCT Pub. Date: Jun. 30, 1988

[30] Foreign Application Priority Data

Dec. 17, 1986 [DE] Fed. Rep. of Germany ..... 3643088

[51] Int. Cl.[5] ..... H01J 29/89

[52] U.S. Cl. ..... 313/478; 313/479; 358/247; 358/252

[58] Field of Search ..... 313/478, 479; 358/247, 358/252

[56] References Cited

U.S. PATENT DOCUMENTS 2,517,774 8/1950 Epstein ..... 313/478 X
3,952,152 4/1976 Lill et al. .
4,563,612 1/1986 Deal et al. ..... 313/478
4,804,883 2/1989 Müller et al. ..... 313/478

FOREIGN PATENT DOCUMENTS 0018667 11/1980 European Pat. Off. .
0119048 9/1984 European Pat. Off. .
2247337 6/1976 Fed. Rep. of Germany .
60-249232 12/1985 Japan .

OTHER PUBLICATIONS

Kazuo Oomae; Patents Abstracts of Japan, Apr. 26, 1986, vol. 10, #11.

*Primary Examiner*—Palmer C. DeMeo
*Attorney, Agent, or Firm*—Spencer & Frank

[57] ABSTRACT

A television picture tube which includes a composite frontal plane comprising a viewing screen which is spherically or aspherically convexly curved relative to the viewer. A convexly curved supplementary plane, preferably made of clear glass, gray glass or machine glass is spaced from the viewing screen by a transparent cast resin layer inserted between the viewing screen and the supplementary pane. The resin layer glues the screen and the pane to one another and has a refraction index which corresponds approximately to that of the supplementary pane and the viewing screen. The supplementary pane is cylindrically curved only about the panes vertical axis and its radius of curvature is significantly larger than the radius of curvature of the viewing screen.

9 Claims, 2 Drawing Sheets

TELEVISION PICTURE TUBE HAVING A COMPOSITE FRONTAL PANE

FIELD OF THE INVENTION

The invention relates to a television picture tube having a composite frontal pane which includes viewing screen which is spherically or aspherically convexly curved relative to the viewer, a convexly curved supplementary pane spaced from the viewing screen, and a transparent cast resin layer inserted between the viewing screen and the supplementary pane for gluing the screen to the pane.

TECHNOLOGY REVIEW

As is known, the viewing screen of a television picture tube has a more or less considerably spherically convex curvature relative to the viewer Moreover, in the course of the further development of television picture tubes, aspherical, so-called FST (flat square tube) tubes have been developed which have a very large radius of curvature in the central region of the viewing screen and a somewhat reduced radius of curvature in its edge regions For example, the two radii are approximately 1.6 m and 1.4 m with a viewing screen diagonal measure of about 0.6 m. With such a viewing screen configuration, distortion in the television image at excessively acute viewing angles is reduced but the viewing screen is still discerned as a curved surface. Moreover, in these flat picture tubes the viewing screen surface is a closer approximation to a planar rectangular surface which, for reasons of image and viewing quality from acute angles and for purposes of design, is considered to be the best.

Additionally, for example DE-AS No. 2,247,337 or U.S. Pat. No. 3,879,627 disclose providing the television tube with a composite frontal pane. The latter is composed of the tube bottom itself—i.e. the viewing screen—, a supplementary pane placed in front of the viewing screen at a distance therefrom and a transparent cast resin layer applied in a form locking manner between the viewing screen and the supplementary pane. This layer firmly connects the viewing screen and the supplementary pane to one another by way of adhesion. The supplementary pane here extends parallel to the frontal face of the viewing screen. This is to avoid distortions and lens effects due to different spaces between these two components Instead of the cast resin layer, a prefabricated plastic molded body with matching refraction index can also be employed whose front or rear surface is completely connected with the supplementary pane and the viewing screen.

The composite frontal pane serves various purposes. On the one hand, it is provided to prevent damage to the picture tube and protect the viewer against shards of glass and other flying parts if the tube should implode. On the other hand, a special configuration of the composite frontal pane may improve the television image. This involves, in particular, the suppression of reflections and double images due to multiple reflections. In principle, the following interfering effects, which adversely influence the television image, are possible:

(a) single and multiple reflections at the front and rear faces of the supplementary pane, the viewing screen and its fluorescent coating;

(b) double images due to multiple reflections and refractions at the above-mentioned faces;

(c) distortions due to very acute viewing angles, particularly in the edge region of the viewing screen.

Picture tubes now have a typical reflection coefficient from 5.5 to 6% which is the sum of the reflections occurring at the two viewing screen faces and at its fluorescent coating. The reflection coefficient of the two faces of a clear-glass supplementary pane lies at about 8%.

The total reflection coefficient of about 12% resulting under consideration of the absorption in glass (transmittance of clear glass is about 90%) can be reduced by means of various measures. If both interfaces of the supplementary pane are made non-reflective, a reflection coefficient of 1% can typically be realized By reducing the transmittance of the supplementary pane, the light beams not reflected by its frontal face are additionally attenuated once during passage to the interior reflecting faces of the supplementary pane or of the viewing screen The intensity of the reflected light component of these beams is again weakened during its passage through the supplementary pane whose transmittance has been reduced to, for example, 60%. Thus, the total reflection coefficient R of the complete system composed of a total of four reflective faces can be reduced, according to the calculation $R=1\%+(0.60^2\times5.5)\%$, to typically 3%. The reduction in transmittance can be realized by the use of gray glass (transmittance about 60%) or even machine-gray glass (transmittance about 30%).

Although the reflection coefficient could be reduced considerably more by making all reflective surfaces non-reflective, this is a very complicated and cost-intensive measure.

The distortion effects listed under (c) above can be reduced by the least possible curvature in the viewing screen of the picture tube and in the supplementary pane.

DE-AS No. 2,247,337 already suggested to produce the cast resin layer between the viewing screen and the supplementary pane from a material having a reduced transmittance. Quite generally, however, reduction of transmittance is limited since it also causes the image quality itself to suffer as the light generated in the fluorescent layer of the television tube must also pass through the light-attenuating layer.

Other references disclosing the state of the art are GB No. 2,170,948, U.S. Pat. Nos. 3,952,152, 4,599,535, JP No. 59/105,191, EP No. 84/301,430 and EP No. 80/102,469.

GB No. 2,170,948 discloses a cathode-ray tube having a spherically curved viewing screen and a likewise spherically curved, low-reflection supplementary pane glued to the viewing screen by means of a cast resin layer. The refraction coefficient of the cast resin layer corresponds approximately to that of the viewing screen and of the supplementary pane, thus creating a so-called "optical bond" between these three components. The composite frontal pane acts essentially as an optically one-piece medium which almost completely suppresses reflections at the interfaces between the cast resin layer or the supplementary pane and the viewing screen. Due to the fact that the thickness of the cast resin layer remains uniform from the center of the composite frontal pane to its edge, distortions of the light beams passing through the composite frontal pane and lens effects need not be feared Since, however, the frontal face of the supplementary pane follows the curvature of the viewing screen, an improvement of the viewing quality at very acute viewing angles cannot be realized.

It must be pointed out that similar cathode-ray tubes are known in which the cast resin layer is replaced by a thin sheet which is self-adhesive on both sides and whose refraction index is again adapted to that of the supplementary pane and of the viewing screen. To produce a perfect optical bond, the three components must be glued together over their entire surface areas. This can be realized only if the radii of curvature of the viewing screen and of the supplementary pane are the same within very close manufacturing tolerances. Accordingly, manufacture of such components is extremely expensive.

For the sake of completeness, reference is made to U.S. Pat. No. 3,952,152, which discloses a cathode-ray tube in which a supplementary pane is employed as implosion protection, but here no optical bond in the form of a cast resin layer is provided between the viewing screen and the supplementary pane. The latter has a larger radius of curvature, at least in its edge region, than the viewing screen, thus creating a space gap between the edges of these two components which is necessary to accommodate the various fastening means for the supplementary pane and a shielding network inserted between the supplementary pane and the viewing screen.

The cathode-ray tube according to U.S. Pat. No. 4,599,535 employs a two-part, planar supplementary pane which is composed of an implosion shield and a filter plate. Due to the planar shape of the supplementary pane, enormous differences in layer thickness result in the center and in the edge region between the supplementary pane and the viewing screen. The use of such an arrangement with a television picture tube having a large-area viewing screen is impossible since the great difference in layer thickness produces annoying distortion and lens effects, particularly in the edge regions, leading to unacceptable image quality. As becomes evident from FIG. 2 of the above-mentioned publication, the disclosed tube is a tube which has a circular viewing screen as it is used, for example, in oscilloscopes, radar screens or the like. In this case, the image quality in the edge regions is by far not as important as in large-area television picture tubes. The same applies analogously for the cathode-ray tubes according to EP No. 84/301,430 and EP No. 80/102,469, since they also employ supplementary panes.

No. JP 59/105,191 discloses a cathode-ray tube equipped with a cylindrical or spherical viewing screen. Such viewing screens are employed for rectangular cathode-ray tubes—i.e. for example in television picture tubes. The cited publication does not provide any information according to which a composite front pane composed of a viewing screen and a supplementary pane is employed in connection with this cathode-ray tube. Rather, this prior publication relates to different measures for improving implosion protection. A so-called clamping band is applied under tension to the joining seam between the edge region of the viewing screen and the remaining funnel-shaped section of the cathode-ray tube. This again places the cylindrical or spherical viewing screen under a mechanical tension which counteracts the atmospheric pressure acting on the evacuated picture tube Due to the special geometry of the clamping band, improved implosion protection is realized with unchanged thickness of the central region of the viewing screen and with reduced tensioning force on the part of the clamping band.

In summary, the prior art discloses cathode-ray tubes equipped with composite frontal panes in which the supplementary pane is glued to the viewing screen by means of a cast resin layer Experience has shown that spherical viewing screens in combination with a planar supplementary pane can be realized only for relatively small-area computer monitors, for oscilloscope screens or the like since there the differences in layer thickness between the center and the edge regions do not become so great Moreover, in the above-mentioned device, the image quality in the edge region does not play the same role as in the large-area television picture tubes Accordingly, losses in image quality due to differences in layer thickness from the center to the edge regions of the viewing screen are acceptable, particularly—in contrast to television picture tubes—since this edge region generally is not used for image reproduction over its entire area.

Television picture tubes employ supplementary panes which are glued on by means of a cast resin layer and follow the curvature of the viewing screen so that the cast resin layer has a constant thickness over the width and height of the viewing screen. This does avoid lens effects, but since, for reasons of stability, the spherical curvature of the viewing screen of the evacuated picture tube must not fall below a certain value, the frontal face of the supplementary pane also has this same curvature. Accordingly, such television picture tubes, which have a large-area viewing screen, are in need of improvement since the curved frontal face of the supplementary pane results in distortions at acute observation angles and a satisfactory approximation to the planar, rectangular frontal face, which is considered to be the best, is not yet realized.

SUMMARY OF THE INVENTION

In view of the above, it is an object of the invention to provide a television picture tube having a composite frontal pane which provides improved image and viewing quality but which is easier to manufacture and is extremely satisfactory in its overall aesthetic impression.

This object is accomplished by a television picture tube which includes a composite frontal pane comprising a viewing screen which is spherically or aspherically convexly curved relative to the viewer. A convexly curved supplementary pane, preferably made of clear glass, gray glass or machine glass is spaced from the viewing screen by a transparent cast resin layer inserted between the viewing screen and the supplementary pane. The resin layer glues the screen and the pane to one another and has a refraction index which corresponds approximately to that of the supplementary pane and the viewing screen. The supplementary pane is cylindrically curved only about the pane's vertical axis and its radius of curvature is significantly larger than the radius of curvature of the viewing screen.

Accordingly, the supplementary pane is curved cylindrically merely in a single direction—namely about the vertical axis. Its radius of curvature is substantially larger than the radius of curvature of the viewing screen. The combination of these features with those of the viewing screen and resin layer results in the following advantages:

Firstly, the frontal face of the invention'supplementary pane is a greatly improved approximation of the planar rectangular shape considered to be optimal for good viewing quality even from acute angles. Due to the lens and distortion effects which result from the great differences in layer thicknesses between the center and the edge regions, this type of good viewing quality has generally not been realized in large-area television picture tubes. Because of the present invention's considerably increased radius of curvature about its vertical axis and the complete absence of curvature in the vertical direction, the television picture tube according to the invention gives the impression to the viewer of a completely planar frontal face. Accordingly, satisfactory viewing comfort can be realized even at acute viewing angles.

Secondly, differences in the thickness of the invention's cast resin layer from the center to the edge regions are acceptable. However, these are limited by the curvature in the direction of the larger width dimension of the viewing screen Surprisingly, however, in spite of the differences in layer thickness, distortion and lens effects which can be measured in television laboratories are not discernible. The image quality of the invention thus corresponds entirely to the presently existing top standard.

Thirdly, the invention's supplementary pane, which is curved only about one axis, is generally easier to manufacture than a spherical supplementary pane which is curved about two axes. Manufacturing costs are reduced correspondingly.

Fourthly, compared to a spherically curved supplementary pane, the invention's cylindrically curved supplementary pane has only an insignificantly reduced bending strength. However, the cylindrically curved supplementary pane has a bending strength which is significantly higher than that of planar supplementary panes. Therefore, an effective implosion protection is provided as before.

Fifthly, since the invention's supplementary pane is curved only slightly in the horizontal direction and not at all in the vertical direction, light reflections originating from external light sources reach the viewer of the frontal face only from a significantly reduced space angle. Thus, in addition to the suppression of reflections by means of the optical bond, the reflection coefficient is reduced by a generally reduced amount of reflection.

Sixthly, in contrast to supplementary panes fastened in front of the viewing screen in a manner freely suspended in the air, the invention's cast resin bond causes the television image to no longer be viewed as through an intermediary show window glass. Instead, the image appears at the frontal interface (frontal face) of the invention's structure as an almost planar surface.

In summary, the television picture tube according to the invention constitutes an extremely successful compromise between image and viewing quality, easy manufacture, effective implosion protection and aesthetically pleasing overall impression.

Advantageous relationships the radii of curvature of viewing screen and supplementary pane include those in which the ratio of the radii of curvature of the viewing screen and the supplementary pane lies between 1:1.2 and 1:3.5, and more particularly between 1:1.8 and 1:2.3.

To further reduce reflections it is sufficient to merely make the frontal face of the supplementary pane nonreflective by the application of a single or multiple layer interference coating This may involve a complicated, multi-layer interference system as well as a simple single-layer $\lambda/4$ coating which, however, because of the already very low reflection coefficient of the structure, is more than sufficient to produce an acceptable improvement in image quality.

An alternative way of making the frontal face nonreflective in an extremely cost-efficient and simple manner to produce a matte surface in a known manner, for example by etching the frontal face. A luster value of about 80 has been found to be favorable. The matte frontal face may additionally also be made nonreflective by means of a single or multiple layer interference coating.

An electrically conductive, anti-statically acting and grounded coating on the back of the supplementary pane permits the realization of various advantages. The coating may be composed of metals, metal alloys, or metal compounds, such as chromium, high-grade steel or silicides, and has a thickness such that its light transmittance is reduced about one-third compared to the uncoated pane. Primarily, electrostatic charges are to be dissipated, thus drastically reducing the tendency of the frontal face to become dirty A typical surface resistance in the coating in of about 15 kOhm is sufficient for this purpose. However, a surface resistance of 30 to 200 Ohm, as is required, for example, for electromagnetic shielding the cathode-ray tube according to EP No. 84/301,430 is not necessary. Rather, the coating is intended to avoid static shock which may occur when a television receiver is turned on and off. Moreover, the coating permits a setting of the transmittance of the composite frontal pane essentially independently of its thickness. This results in uniform brightness distribution from the center to the edge regions of the frontal pane Finally, the coating is set optically in such a manner that practically no interference occurs at the optical transition from the coating to the cast resin. This means that no annoying double images are perceived. In one embodiment the coating on the back can be applied by magnetron cathode sputtering. Such a coating is corrosion resistant, wear resistant and extremely economical. In transmitted light as well as in incident light, the conductive coating absorbs in a manner extremely neutral to colors, i.e. no color falsification whatsoever occurs in color television receivers.

The invention will now be described in greater detail for an embodiment thereof and with reference to the attached drawing.

DETAILED DESCRIPTION OF THE PREFERRED EMBODIMENTS

Figure 1:
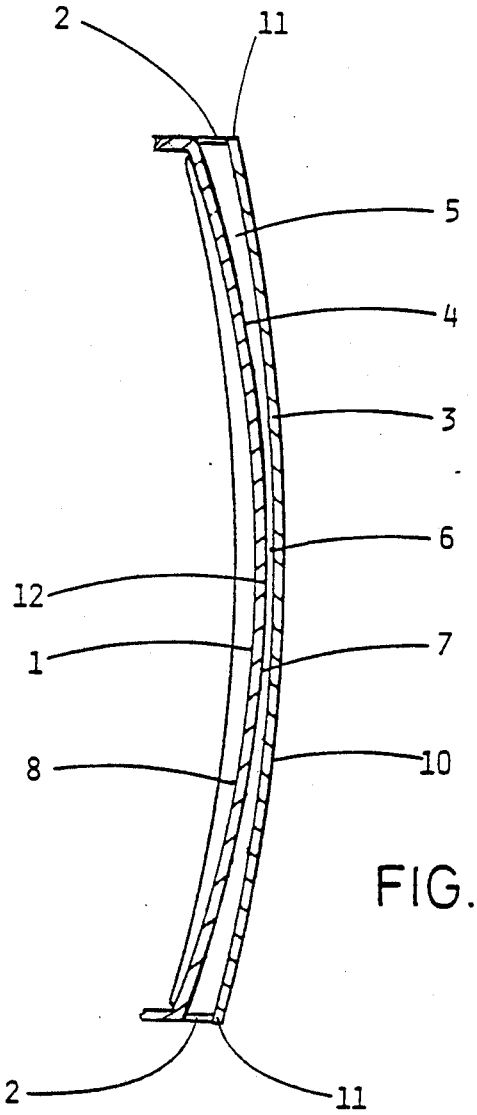
FIG. 1 is a horizontal sectional view of the composite frontal pane of the television tube.

The supporting member of the composite frontal pane is the flat, spherically convexly curved viewing screen (1) of a television receiver. The picture tube is a so-called FST (flat square tube) tube. Spacers (2) arranged either circumferentially along the edges or only in the corner regions hold a supplementary pane (3) at a distance from the frontal face (4) of the viewing screen (1). The space between supplementary pane (3) and viewing screen (1) is completely filled by a layer of cast resin (5), which glues the two above-mentioned components to one another. The cast resin layer (5) is transparent, neutral in color, low in absorption and has a refraction index corresponding approximately to that of the viewing screen (1) and of the supplementary pane (3). Representative values for the refraction indices of the viewing screen and the supplementary pane as well as the cast resin layer are 1.52, 1.45 and 1.48. The interfaces (6, 7) between the cast resin layer (5) and the viewing screen (1) and the supplementary pane (3), respectively, thus reflect with a residual reflection coefficient of 0.06% or less. The back (8) of the viewing screen (1) and its fluorescent coating (9) as well as the frontal face (10) of the supplementary pane (3) are essentially the only remaining reflecting surfaces.

As shown in FIG. 1, the spherically curved viewing screen (1) has a smaller radius of curvature than the supplementary pane (3) which is cylindrically curved about the vertical axis With a diagonal viewing screen measuring 70 cm in length, the radius of curvature of the viewing screen is, for example, 160 to 170 cm, while the radius of curvature of the supplementary pane lies approximately at 360 cm. The ratio of the radii thus lies at about 1:2.1. The horizontal, long lateral edges at the upper and underside of the supplementary pane (3) are very slightly curved while the vertically oriented, short lateral edges (11) have a linear configuration.

Figure 2:
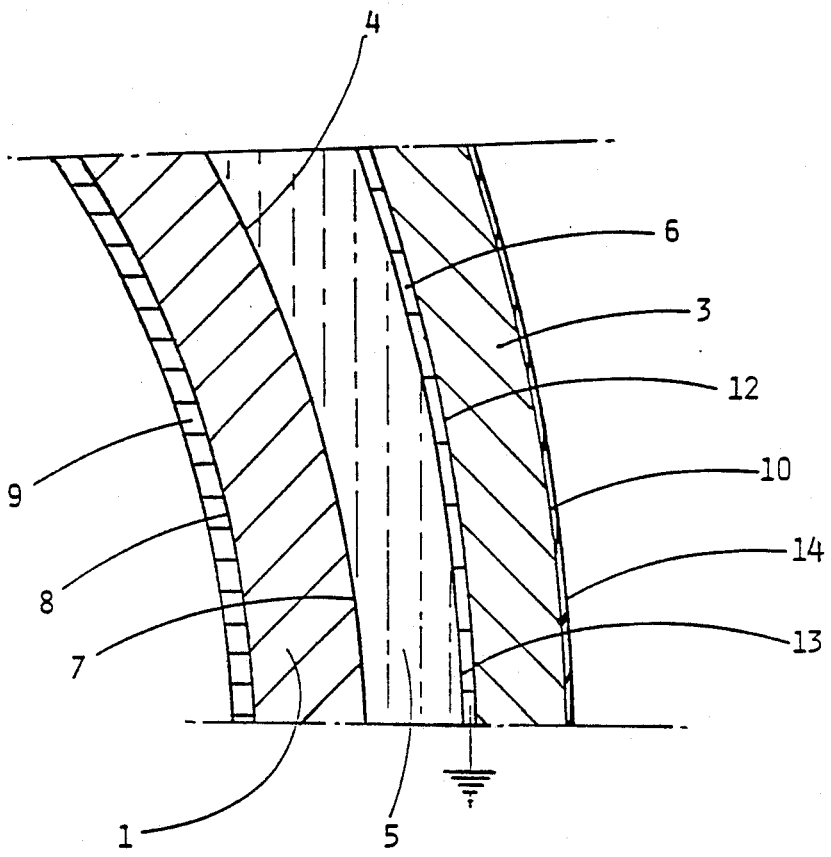
FIG. 2 is a detail view in horizontal section and to an enlarged scale.

As shown in FIG. 2, the frontal face (10) of the supplementary pane (3) may additionally be provided with a multi-layer $\lambda/4$ coating (14) which may be produced, for example, by a sputtering process and constitutes a simple and cost effective reflection reducing measure The disclosed composite frontal pane with its simple non-reflective coating and the cast resin layer (5) adapted to the refraction index permit the realization of a total reflection coefficient of about 1.9%.

High quality reflection reducing measures—for example by means of multi-layer vapor deposition systems (including, inter alia, an exterior $MgF_2$ layer)—permit this total reflection coefficient to be pushed down to about 1.6%.

FIG. 2 additionally shows a coating on the back (12) of the supplementary pane (3). This is a conductive, externally grounded absorption coating (13) composed of a single-layer structure of chromium, a chromium alloy or a silicide. The thickness of this absorption coating (13) is set so that the transmittance is reduced by one third. The surface resistance of the absorption coating is about 15 kOhm.

I claim:

1. A television picture tube including a composite frontal pane comprising:

a viewing screen which is spherically or aspherically convexly curved relative to a viewer thereof;

a convexly curved light-transparent supplementary pane spaced from said viewing screen; and a transparent cast resin layer inserted between said viewing screen and said supplementary pane for gluing said screen and said pane to one another, said cast resin layer having a refraction index which corresponds approximately to that of said supplementary pane and said viewing screen, wherein said supplementary pane is cylindrically curved only about the vertical axis of said pane and the radius of curvature of said pane is significantly larger than the radius of curvature of said viewing screen.

2. The television picture tube according to claim 1, wherein the ratio of the radii of curvature of the viewing screen and the supplementary pane lies between 1:1.2 and 1:3.5.

3. The television picture tube according to claim 2, wherein the ratio of the radii of curvature of the viewing screen and the supplementary pane lies between 1:1.8 and 1:2.3.

4. The television picture tube according to claim 1, wherein said supplementary pane has a frontal face which is made non-reflective by the application of a single or multiple layer interference coating.

5. The television picture tube according to claim 1, wherein said supplementary pane has a frontal face with a matte finish.

6. The television picture tube according to claim 1, wherein said supplementary pane has a back provided with an electrically conductive, anti-statically acting and grounded coating.

7. The television picture tube according to claim 6, wherein said coating on the back of said supplementary pane is a material selected from the group consisting of metals, metal alloys and metal compounds and has such a thickness that its light transmittance is reduced by about one third compared to the uncoated pane.

8. The television picture tube according to claim 7, wherein said coating is a material selected from the group consisting of chromium, high-grade steel and silicides.

9. The television picture tube according to claim 1, wherein said convexly curved supplementary pane is made of a material selected from the group consisting of clear glass, gray glass or machine-gray glass.

* * * * *